US005214584A

United States Patent [19]

Dingee et al.

[11] Patent Number: 5,214,584

[45] Date of Patent: May 25, 1993

[54] BIDIRECTIONAL DATA INTERFACE FOR A PROCESSOR EMBEDDED IN A SELF-PROPELLED VEHICLE

[75] Inventors: D. A. Dingee; M. R. Silva, both of Alta Loma, Calif.

[73] Assignee: Hughes Aircraft Company, Los Angeles, Calif.

[21] Appl. No.: 815,894

[22] Filed: Dec. 31, 1991

Related U.S. Application Data

[63] Continuation of Ser. No. 456,410, Dec. 26, 1989, abandoned.

[51] Int. Cl.[5] ..... G06F 15/50; F41G 7/24

[52] U.S. Cl. ..... 364/423; 364/424.01; 244/3.11; 244/3.14; 395/800

[58] Field of Search ..... 364/423, 424.01, 424.02, 364/424.05, 424.06; 244/3.11, 3.12, 3.14; 395/200, 375, 800

[56] References Cited

U.S. PATENT DOCUMENTS

| | | | |
|---|---|---|---|
| 3,962,537 | 6/1976 | Kearns et al. | 244/3.14 |
| 3,997,762 | 12/1976 | Ritchie et al. | 235/61.5 |
| 4,013,875 | 3/1977 | McGlynn | 235/150 |
| 4,185,796 | 1/1980 | Riley | 244/3.12 |
| 4,247,059 | 1/1981 | Duke et al. | 244/3.12 |
| 4,288,049 | 9/1981 | Alpers | 244/3.14 |
| 4,318,330 | 3/1982 | Hausenblas | 89/41 |
| 4,442,431 | 4/1984 | Bleakney | 244/3.14 |
| 4,559,612 | 12/1985 | Vrielink | 364/900 |
| 4,611,771 | 9/1986 | Gibbons et al. | 244/3.12 |
| 4,647,759 | 3/1987 | Worsham et al. | 235/411 |
| 4,660,170 | 4/1987 | Hui et al. | 364/900 |
| 4,747,041 | 5/1988 | Engel et al. | 364/200 |
| 4,907,763 | 3/1990 | Pinson | 244/3.12 |

FOREIGN PATENT DOCUMENTS

| | | |
|---|---|---|
| 1473732 | 4/1966 | France . |
| 2017986 | 10/1979 | United Kingdom . |

*Primary Examiner*—Vincent N. Trans

*Attorney, Agent, or Firm*—C. D. Brown; R. M. Heald; W. K. Denson-Low

[57] ABSTRACT

In a self-propelled vehicle such as a shoulder-fired missile, a bidirectional data interface between a missile processor and an external apparatus includes a pair of function signal paths which extend partly outside the missile. A first component of the interface uses one of the signal paths to couple reprogramming information to the missile processor in response to a prompt from the processor. A second component of the interface responds to a periodic signal on the second signal path to receive missile processor data which the missile processor connects to the first signal path in synchronism with the periodic signal.

15 Claims, 3 Drawing Sheets

BIDIRECTIONAL DATA INTERFACE FOR A PROCESSOR EMBEDDED IN A SELF-PROPELLED VEHICLE

This is a continuation of application Ser. No. 07/456,410, filed Dec. 26, 1989, now abandoned.

BACKGROUND OF THE INVENTION

The invention is in the field of bidirectional data transfer between a processor embedded in a self-propelled vehicle, such as a shoulder-fired missile, and electronics external to the vehicle. The bidirectional transfer is for the purpose of integrating embedded electronics with external functionalities and components.

The problem of reprogramming a processor-controlled unmanned weapon is discussed in detail in U.S. Pat. No. 4,660,170, assigned to the assignee of this application and incorporated herein by reference. The invention described and claimed in the incorporated patent provides for reprogramming a missile. Such reprogramming provides significant flexibility in a battlefield in which the conditions of using the missile constantly change. The patent provides an interface which permits reprogramming of a processor embedded in the missile to accommodate change to targeting parameters. The direction of conductivity is from a reprogramming apparatus external to the missile into the processor embedded in the missile.

The unidirectional reprogramming route into the missile consists of one of a plurality of active signal paths between the interior and exterior of the missile. The signal path is accessed with a pair of synchronized switches, one within the missile, and one in a reprogramming module external to the missile. The switches are connected to the active signal path and a reprogramming protocol operates the switches to connect that signal path to the reprogramming apparatus and to the embedded processor for as long as reprogramming data is conducted. When the reprogramming sequence is ended, a final handshake operates the switches to restore the signal path to its original functionality.

Advances in battlefield command, control, and communications have resulted in an accelerated integration of battlefield assets. This trend is supported particularly by the wide use of microprocessing technology to implement weapon operations. The trend is further supported by the integration of battlefield communications, which provides a means to link weapon processors with centralized fire control processors.

When one considers a shoulder-fired weapon with computerized target, guidance, and flight control, which would be "on line" in the battlefield, it will be clear that advantage can be gained by integrating the weapon's electronics with an external fire control computer. This would permit fusion of the targeting sensors in the missile which collect real-time information about potential targets with other sensors external to the missile. All the sensor information can be passed to the fire control computer, which would survey the information and decide on a set of programs to load into the missile which are optimized for the instant battlefield conditions. A supplemental result would be to obtain additional information from the missile for the fire control computer prior to launching so that the launching could be coordinated in a firing sequence with other weapons.

Integration of weapon electronics with external battlefield control electronics requires bidirectional transfer between the components embedded in the weapon and the external components. Bidirectionality is necessary in order to provide up-to-date information from targeting and guidance components of the missile to the external fire control computer, and to permit last minute programming of the missile targeting intelligence by the fire control computer.

The reprogramming system of the incorporated U.S. Patent supports one leg of the bidirectional link; the need, therefore, is for a second leg of the bidrectional link, the outward bound one from the missile to the external components. This leg should, preferably, be integrated functionally with the inbound leg into the missile.

SUMMARY OF THE INVENTION

The invention arises from the inventors' observation that the operational flow of electronics embedded in the missile provides the means to synchronize, and thereby, functionally integrate, data transfer into the missile with data transfer from the missile in a half-duplex manner. This allows the external signal path described in the incorporated patent to be used for data transfer in both directions. The invention provides a set of terminal components external to the missile for receiving data transfer on this signal path from the interior of the missile. The components described in the patent transfer data into the missile, thereby giving a bi-directional data path between the exterior and interior of the missile.

It is therefore an objective of this invention to utilize an existing unidirectional data path which transfers reprogramming data into the electronics of an unmanned, self-propelled vehicle, such as a missile, for the purpose of also transferring information from the embedded electronics to electronics external to the vehicle.

With the achievement of this objective, the bidirectional data path gives the advantage of integrating target and guidance components internal to the missile with fire control components external to the missile.

The achievement of these and other objectives and advantages will be appreciated when the detailed description of the invention is read with reference to the below-described drawings.

DETAILED DESCRIPTION OF THE PREFERRED EMBODIMENTS

Figure 1:
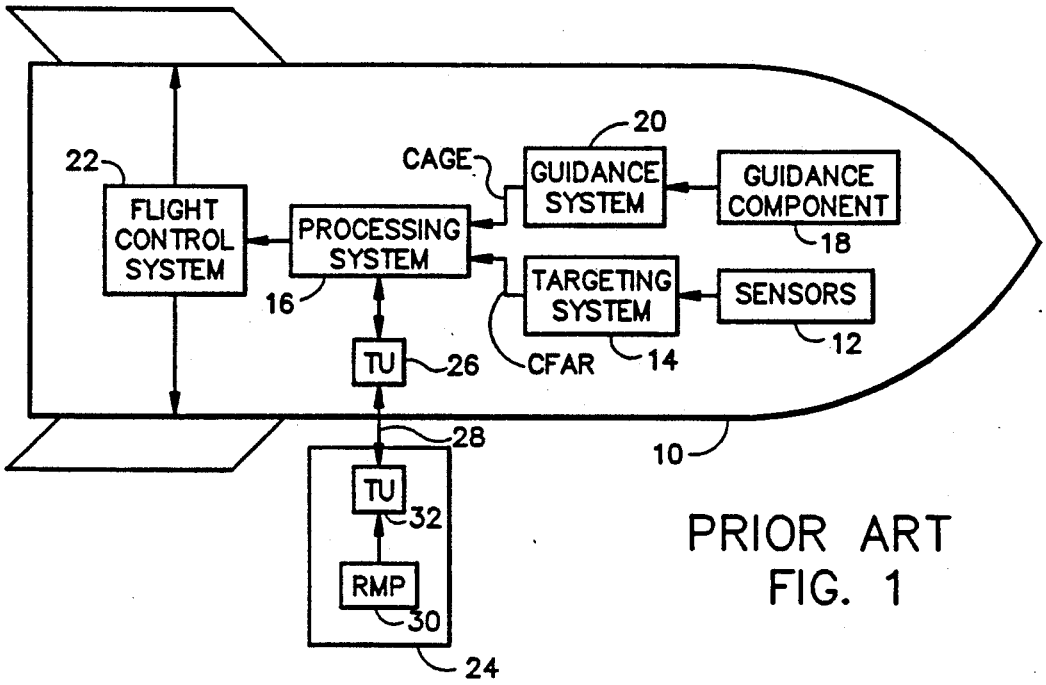
PRIOR ART FIG. 1
FIG. 1 illustrates a basic complement of functional components which are internal and external to a shoulder-fired guided missile.

FIG. 1 shows an unmanned, self-propelled and self-guided flying vehicle in the form of a shoulder-fired missile, preferably of the Stinger type manufactured by the assignee of this patent. FIG. 1 illustrates a prior art set of components used to reprogram the missile 10. The missile 10 includes a set of sensors 12 having configurations and operational characteristics which are known, and which provide sensor signals to a targeting system 14. The targeting system 14 collects and formats the sensor signals, forwarding them to a processing system 16. The processing system 16 also receives guidance signals which are developed by operation of a guidance component 18 such as a gyroscope, that feeds gyro signals to a guidance system 20. The guidance system 20 collects and formats the guidance component signals and provides them to the processing system 16.

The processing system 16 is programmed to receive the guidance and targeting signals and to subject them to equations for selecting a target and for controlling the flight of the missile 10 to the target. The equation solutions are passed in the form of flight control signals to a flight control system 22 which operates flight control surfaces of the missile to conventionally steer it to its selected target.

The missile 10 is presently reprogrammed through a reprogramming link including a reprogramming module 24 external to the missile 10, a missile terminal unit 26 within the missile 10, and a function signal path 28, having a portion extending outside of the missile 10. The remote programming module is contained in a missile gripstock (not shown) and includes a reprogramming module processor (RMP) 30, and an external terminal unit 32. In operation, the control sequence generated by the processing system 16 includes control signals to configure the terminal unit 26 to couple the control sequence onto the function signal line 28. Simultaneously, the terminal unit 26 provides an alternate path for the function signal which is transmitted on the signal line 28, the alternate path being internal to the missile 10. The command sequence is conducted on the signal line 28 and passed through the terminal unit 32 to the RMP 30. Upon recognizing the sequence, the RMP 30 operates the terminal unit 32 for connection of reprogramming data signals onto the signal path 28. Reprogramming is then conducted on the signal path 32, 28, 26, 16. The end of the reprogramming sequence is indicated by a particular configuration in the reprogramming signals. When the sequence is ended, the RMP 30 switches the terminal unit 32 so that outgoing function signals on the signal path 28 are returned to the missile 10. Similarly, when the processing system 16 recognizes the end-of-sequence configuration in the reprogramming data, it disconnects the terminal unit 26 from the signal line 28 and reconnects the signal line 28 to the function unit signal source within the missile 10.

Figure 2:
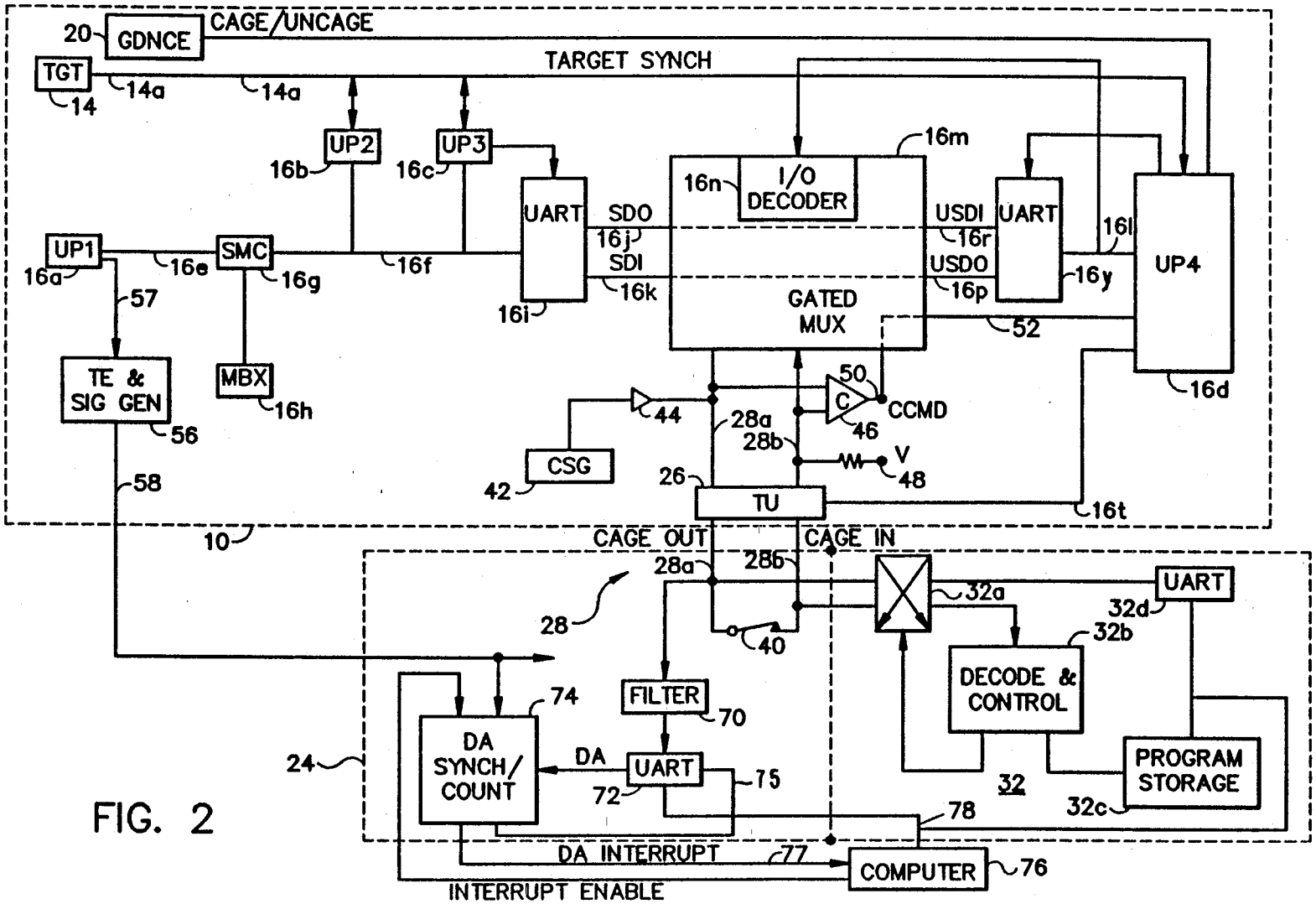
FIG. 2 is a block diagram illustrating the bi-directional data link of the invention which supports data transfer between missile electronics and external electronic components.

For an understanding of the invention, reference is now given to FIG. 2, which is a block diagram illustrating the bidirectional data path of this invention together with prior art elements of FIG. 1, which are shown in greater detail.

The function signal line utilized in both the prior art and in this invention is a CAGE line. In this regard, the CAGE function refers to a process of setting the axis of a gyroscope to a reference position. A signal to control this function is provided on a pair of signal lines 28*a* and 28*b*, each of which extends out of the missile 10 into the missile gripstock (not shown). In the gripstock the signal lines 28*a* and 28*b* are connected through an uncage switch 40. The purpose of this external loop is to provide an indication to the missile guidance electronics that a firing sequence has begun. This occurs when the operator throws the switch 40, opening the connection between the signal line 28*a* and signal line 28*b*. The CAGE signal is generated by a cage signal generator (CSG) 42 and fed through a buffer 44 onto the signal line 28*a*. The output of the buffer 44 is also fed to one input of a comparator (C) 46. The other input of the comparator 46 is connected to the signal line 28*b*. While the switch 40 is closed, the same potential is present on signal lines 28*a* and 28*b*, and the output of the comparator 46 has a first state. When the switch 40 is opened, the potential on the signal line 28*b* changes to V which is present at the voltage node 48. The change in voltage trips the output of the comparator 46 to a second level, which indicates the presence of a cage command (CCMD).

The prior art processor system 16 includes four distributed microprocessors 16*a*, 16*b*, 16*c*, and 16*d*. The processor 16*a* has a data bus 16*e*, while the processors 16*b* and 16*c* share a common data bus 16*f*. The data buses 16*e* and 16*f* are connected through a shared memory controller 16*g* to a shared data passing mailbox (MBX) 16*h*. The mailbox 16*h* is provided for staging of data which is to be exchanged among all four of the microprocessors 16*a*–16*d*. The data bus 16*f* is connected also to a conventional universal asynchronous receive-transmit (UART) device 16*i*. The UART 16*i* provides conventional parallel/serial conversion between the data bus 16*f* and two data lines 16*j* and 16*k*. The line 16*j* is a serial data out (SDO) line which conducts serial data in conventional format from the UART 16*i*, while the serial line 16*k* connects serial data in (SDI) to the UART 16*i*. The microprocessor 16*d* has a data bus 161 which connects both to a UART 16*y* and to the decoder (I/O DECODER) portion 16*n* of a gated multiplexor 16*m*. The UART 16*y* is connected by a serial data output line 16*p* and a serial data input line 16*r* to the gated multiplexor 16*m*. Also connected to the multiplexor 16*m* are the signal lines 16*j* and 16*k* of the UART 16*i*, the function signal lines 28*a* and 28*b*, the CCMD signal line 50, and the CCMD input line 52, which conducts the CCMD signal to the microprocessor 16*d*.

Figure 3A:
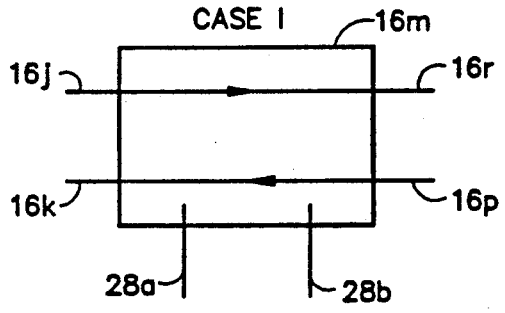
FIGS. 3A and 3B are block diagrams illustrating a data multiplexor internal to the missile and controlled by a missile microprocessor.
Figure 3B:
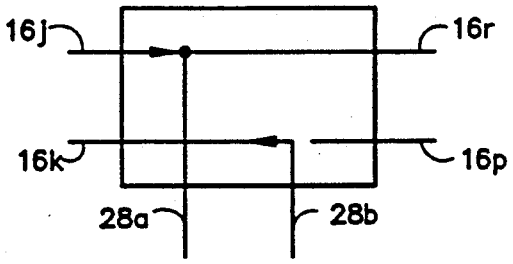

The gated multiplexor 16*m* is a multimode device controlled by the microprocessor 16*d*. Two modes ("cases") of the multiplexor 16*m* are illustrated in FIGS. 3A and 3B. In case I, the multiplexor directly connects the serial data output line 16*j* with the serial data input line 16*r*. It also connects the serial data output line 16*p* with the serial data input line 16*k*. The connections of the CAGE OUT and CAGE IN data paths 28*a* and 28*b* are not shown in FIG. 3A because they are irrelevant to an understanding of the invention. In case I, the processing system 16 of the missile 10 is set up for interprocessor communications by way of the mailbox 16*h*. The mailbox 16*h* is operated conventionally by the controller 16*g* to receive and store messages from any of the microprocessors 16*a*–16*d* and to provide the messages to any requested microprocessor. Mailbox access for the microprocessor 16*d* is provided in case I by way of the signal path 16*y*, 16*p*, 16*r*, 16*j*, 16*k*, 16*i*. This arrangement is dictated by physical construction details of the missile 10 which are irrelevant to an understanding of this invention.

The gated multiplexor 16m is configured in case II as illustrated in FIG. 3B. In this configuration, the connection between the serial lines 16k and 16p is broken, while the CAGE OUT signal path 28a is connected to the serial connection between 16j and 16r. In addition, the return portion 28b of the CAGE signal path is connected to the serial data path 16k.

Each of these cases is entered under control of the microprocessor 16d, which writes a control word to its own I/O port, the control word being conducted on the data bus 161 to the decoder 16n. The control word controls the multiplexor cases. Case II is used for transmission of missile electronics data from the missile to the set of external components 24 on the CAGE OUT signal line 28a.

Continuing, in FIG. 2, with the explanation of the prior art components of the missile 10, the target system 14 includes target sensors that employ periodic, scanning-type techniques for target acquisition. Conveniently, the targeting system 14 synchronizes the operations of the microprocessors 16a–16d to target sensor scanning operation by provision of a periodic synchronizing signal (TARGET SYNC) on signal line 14a. In the prior art Stinger missile, this signal is used to synchronize a string of words from the microprocessor 16c to the microprocessor 16d. These words completely characterize the status of the missile electronics, including the current state of target and guidance data being processed by the processing system 16. This is the data which the inventors have found useful to transfer from the missile to the external components for the purposes described above. In the invention, this data is transferred by placing the multiplexor 16m in case II, so that the data is conducted on the CAGE OUT line 28a.

Also in the prior art of the Stinger missile, the microprocessor 16a responds to the TARGET SYNC signal by producing on signal line 57 a status word providing the value for predetermined test and evaluation (TE) parameters within the missile. The word is provided to a signal generator 56 which converts it to a multi-level TE signal which is conducted outside the missile on signal line 58. The leading portion of the TE signal produced by the generator 56 includes a component synchronized to the TARGET SYNC signal. In the invention, this component provides the synchronization between internal missile operations and the operations of the external components.

Completing the description of prior art, the unidirectional reprogramming link described in the incorporated patent is illustrated in FIG. 2 by the components 26, 28, 32. As FIG. 2 illustrates, the microprocessor 16d controls the terminal unit 26 to configure the signal lines 28a and 28b as described above. For reprogramming, microprocessor 16d configures the unit 26 to provide a connection between the portions of the signal lines 28a and 28b which are internal to the missile 10, while connecting the external portion of the CAGE IN signal path 28b to the processor 16d by way of the signal path 16t. The reprogramming command sequence is then transmitted by way of the signal path 16t, 26, 28a (external) to the external reprogramming terminal unit 32. The unit 32 has a switch unit 32a which continuously connects the external portion of the CAGE OUT signal line 28a to a decode and control unit 32b. When the command sequence is placed on the CAGE OUT signal line, the decode and control unit 32b operates the switch 32a to connect a program storage module 32c through a UART 32d to the external portion of the CAGE IN signal line 28b. Reprogramming is then conducted by the signal path 32c, 32d, 32a, 28b, 26, 16t. When the reprogramming sequence is ended, the terminal unit 26 is reset to connect the internal and external portions of the signal lines 28a and 28b respectively, while the external terminal unit switch 32a is reset to disconnect the UART 32d from the external portion of the CAGE IN line 28b.

This completes the explanation of the input portion of the bidirectional link of this invention. More precise details are given in the incorporated patent.

It is asserted that the prior art module 32c is a preprogrammed ROM module in which the reprogramming data has been stored. In the invention, this module comprises RAM components which can be programmed in real time in response to battlefield conditions and to the data obtained by the invention from the missile 10.

Prior to describing the outward bound portion of the bidirectional link, the inventors state that the microprocessor 16d is programmed to maintain the gated multiplexor 16m in case I during normal operation. Further, the microprocessor 16d is programmed to conduct the activities described below with regard to outward bound data transfer during a time period separate and distinct from the reprogramming time period and synchronized with the TARGET SYNC signal.

The external components which receive the data transferred from the interior of the missile 10 include a high-pass filter 70, a UART 72, and a data available synchronizing and counting circuit 74 (DA SYNCH-/COUNT). Completing the complement of external components necessary to operation of the bidirectional data interface of this invention is a programmable computer 76. This computer can be programmed conventionally for fire control tasks. The computer 76 includes a data bus 78 on which it provides reprogramming data to the program storage 32c in the terminal unit 32 and on which it receives outward bound data from the missile 10 by way of the signal path 28a, 70, 72. To synchronize the operations of the computer 76 with the provision of the outward bound data, the circuit 74 receives the TE signal on signal line 58, as well as an INTERRUPT ENABLE signal from the computer 76. The INTERRUPT ENABLE signal is provided by computer 76 when it is ready to accept the outward bound data; the circuit 74 looks for the concurrence of this signal with the target sync portion of the TE signal. Upon detecting this concurrence, the circuit 74 provides a GATE signal on signal line 75 which enables the DA interrupt on signal line 77 indicating to the computer 76 that the output of the UART is, in fact, the data being transferred from the interior of the missile 10. The data transferred from the missile 10 is digital data which is passed by the high-pass filter 70 to the UART 72. Each time a complete word is received by the UART 72 it outputs a data acquisition (DA) signal. The DA signals output by the UART 72 are counted by the circuit 74 until the expected number of words being transferred to the microprocessor 16d are counted. At this time, the circuit 74 deactivates the GATE signal on signal line 75, thereby disabling the DA interrupt (signal line 77) and indicating to the computer 76 that the transmission from the missile 10 is completed.

Figure 4:
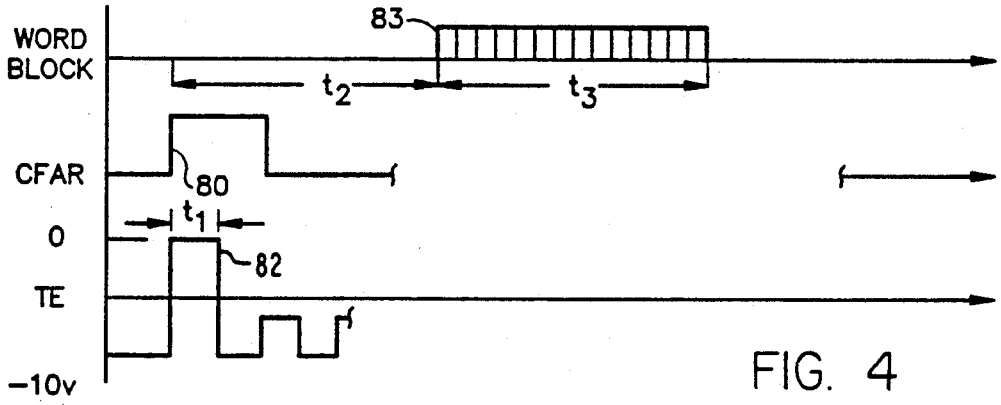
FIG. 4 is a waveform diagram illustrating relationships between signals produced by components included in the block diagram of FIG. 2.
Figure 6:
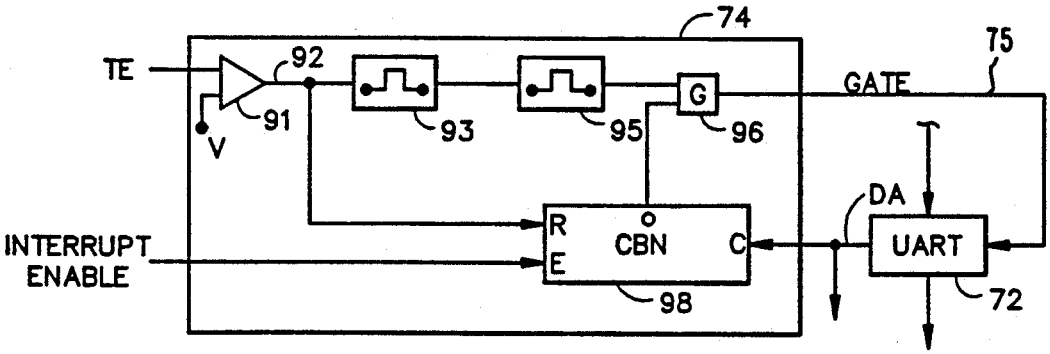
FIG. 6 is a block diagram illustrating, in detail, the components of a synchronizing and counting circuit.

FIGS. 2, 4 and 6 illustrate the operation of the circuit 74. During missile operations, n words are transferred in sequence to the microprocessor 16d, as described above. These words are transmitted through the gated multiplexor 16m only after an exchange of handshaking signals between the microprocessors 16c and 16d. The handshaking procedure is initiated in response to the TARGET SYNC signal referred to hereinafter as the CFAR signal. Further, the TE signal is generated by the microprocessor 16a in response to an internal CFAR signal. These signal relationships are illustrated in FIG. 4 where the rising edge 80 of the CFAR signal results in the negative transition 82 of TE signal being produced after a delay $t_1$. Further, after a delay $t_2$ from the rising edge 80, a block of n words beginning at 83 is transferred to the microprocessor 16d. These timing relationships are accounted for by the circuit 74 which is illustrated in greater detail in FIG. 6. The circuit 74 gates the block of n words in synchronism with transmission of the block to the microprocessor 16d. The leading negative edge 82 of the TE signal is detected by a comparator 91, which generates a trigger signal in response to the negative edge 82. The trigger signal fires a one-shot 93 whose output is delayed by the time $t_2-t_1$. The delayed output of the one-shot 93 is fed to a one-shot 95 which produces a pulse having a duration longer than $t_3$. The output of the one-shot 95 is fed to a gate circuit (G) 96. A count-by-n (CBn) counter 98 is reset by the trigger pulse produced by the comparator 92 and is enabled by the INTERRUPT ENABLE signal produced by the computer 76. The output of the counter 98 rises when the counter is reset and enabled. This output is fed to the gate circuit 96. With the concurrence of the pulse produced by the one-shot 95 and the output of the counter 98, the output of the gate circuit 96 rises to activate the GATE signal. Activation of the GATE signal enables the UART 72 to accept data on the signal line 28a and enables the DA interrupt. The DA interrupt signal is fed to the computer 76 to notify it that the UART 72 will forward data received from the missile 10.

As the sequence of n words starting at 83 in FIG. 4 is fed to the UART 72, the UART, for each word, activates a data acquisition (DA) signal which is fed to the count (C) input of the counter 98. When n of these DA signals have been counted, the output of the counter falls, deactivating the GATE signal. In this manner, precisely n words are counted through the UART 72, with the timing of the one-shots 93 and 95 being such that the counting is in phase with the n words transferred to the microprocessor 16d and with the CFAR signal. The computer 76 receives these n words from the UART 72 on the data bus 78.

When programmed as a fire control computer, the computer 76 integrates the data received from the missile 10 with other relevant data to generate and load to the module 32c updated reprogramming data for the missile processing system.

Figure 5:
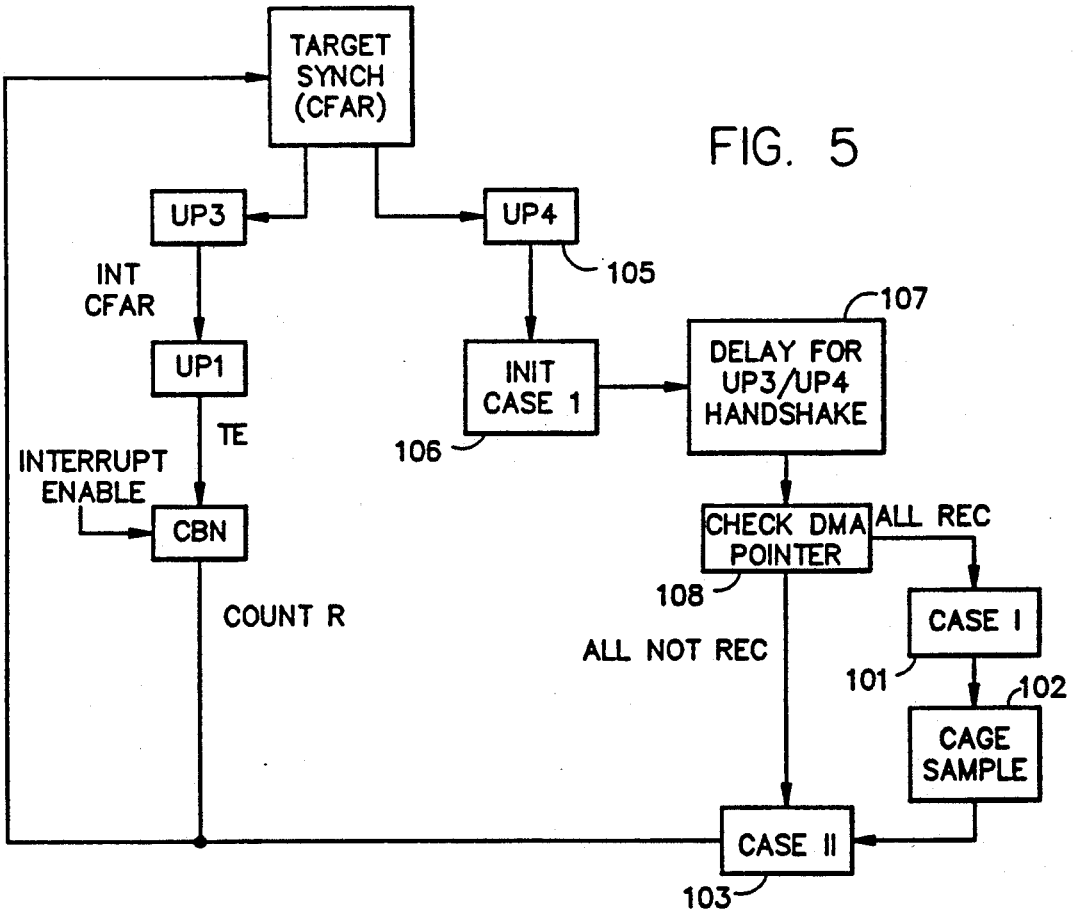
FIG. 5 is a state transition diagram illustrating a protocol for transferring data from internal missile electronics to external components.

Refer now to FIGS. 2 and 5 for an understanding of the internal protocol of the missile electronics which is used to implement the outward bound transfer of data. FIG. 5 is a combination state and function flow diagram, and begins with production of the CFAR signal which is fed to the microprocessors 16c and 16d. Receipt of the internal CFAR signal causes the microprocessor 16a to generate the TE signal, with the negative transition 82 illustrated in FIG. 4. Receipt of the TE signal and the INTERRUPT ENABLE will commence the count-by-n (CBn) process described above with reference to FIGS. 4 and 6.

To ensure that the n words are transferred internally in the missile with the multiplexor 16m properly gated, and that all other internal functions are still properly executed, the microprocessor 16d responds to the CFAR signal by initially placing the multiplexor 16m in case I. The multiplexor is kept in case I for an amount of time sufficient to permit the handshaking necessary to transfer the n words to the microprocessor 16d. When the handshake is complete, the microprocessor 16d checks its DMA pointer. The transferred words are counted into the microprocessor 16d by incrementing the DMA pointer in this microprocessor as each word is received. If all n words have been received as indicated by the DMA pointer, the multiplexor 16m is set to case I, cage sampling occurs, and then the multiplexor 16m is set to case II.

With the multiplexor in case I, the microprocessor 16d will sense the CAGE signal status by sampling the CCMD on signal line 52. This is illustrated in FIG. 2. With the multiplexor in case I, the CAGE IN line 28b is disconnected from the SDI signal line 16k. In this case, the closed switch 40 shorts out the CAGE lines 28a and 28b and holds the missile in a caged state since the voltage level on signal line 28b never transitions above a predetermined level. If the switch 40 is opened by a missile operator, the signal line 28b is connected to the voltage source 48, which exceeds the predetermined level, causing the output of the comparator 46 to activate CCMD signal. This signal is sampled on signal line 52 to determine if the missile guidance system is caged or uncaged. While the multiplexor 16m is in case II, and the uncaged switch 40 is thrown, the line 28b is driven by the digital logic levels present on the signal line 16k. Instead of transitioning to the voltage level V at node 48, the CAGE IN line 28b never exceeds the maximum digital level, and thus will prevent a transition in the output of the comparator 46 to indicate an uncaged position. However, since the microprocessor 16d only samples the CCMD line 52 at certain times, maintenance of the case II multiplexor state between sampling periods will not mask the true analogue signal level of the CAGE IN line 28b. The operation of the microprocessor 16d is established to permit sampling of the CCMD line 52 during a word block transfer only under condition that all words are received. This case is illustrated in FIG. 5, wherein, the multiplexor 16m is set to case I in step 101 and the line 52 is sampled in step 102, with the multiplexor being reset to case II in step 103. If the DMA pointer of the microprocessor 16d indicates that all n of the words in the block have not been received, the procedure transitions from state 108 directly to 103. In this transition, the multiplexor 16m is set to case II and the cage sample interrupt of the microprocessor 16d is suppressed. However, at the next CFAR signal, the state transition 105, 106, 107 initializes the multiplexor to case I and permits the CCMD sampling interrupt routine of the microprocessor 16d to be dispatched. In this case, the comparator 46 will provided an accurate indication of the state of the switch 40. Therefore, the CCMD sample will be valid.

Although our invention has been described with reference to a preferred embodiment, those skilled in the art will appreciate that the invention is capable of a variety of embodiments, all of which fall within the scope of the following claims.

We claim:

1. In an unmanned, self-propelled flying vehicle and launching apparatus, a combination, comprising:

guidance means on board the vehicle for producing guidance data signals for guiding said vehicle;

target sensing means on board the vehicle for generating target data signals for identifying a target;

a processing means on board the vehicle and coupled to the guidance means and target sensing means for producing flight control signals to guide the vehicle to a target during flight by executing a program including target selection and flight control program data in response to the guidance data signals and target data signals;

a first signal path means coupled to the processing means and having a signal path portion external to the vehicle and coupled to the launching apparatus, said external first signal path portion being coupled to said processing means only prior to a launch of said vehicle, the first signal path means being for conducting;

a guidance synchronizing signal to the processing means;

programming commands from the processing means;

target selection and flight control programming data to the processing means; and guidance data signals and target data signals from the processing means;

a second signal path means coupled to the processing means and including a signal path portion external to the vehicle coupled to the launching apparatus for conducing a periodic utility signal from the processing means, said external second signal path portion being coupled to said processing means only prior to launch of said vehicle;

programming information means external to the vehicle for providing the target selection and flight control programming data in response to the programming commands;

programming switch means coupled to the external signal path portion of the first signal path means and to the programming information means for conducting the target selection and flight control program data to the external signal path portion of the first signal path means and for conducting the programming commands to the programming information means;

information receiving means external to the vehicle and connected to the external signal path portion of the first signal path means and to the external signal path portion of the second signal path means for receiving the guidance data signals and target data signals in synchronism with the periodic utility signal; and computer means coupled to the information receiving means and to the programming information means for generating the target selection and flight control programming data in response to the guidance data signals and target data signals;

all communications over the first and second signal paths external to said vehicle into said vehicle ceasing upon launch of said vehicle.

2. A system for transferring data to and from a self-guided flying vehicle and its launching apparatus having a plurality of signal paths for conducting signals into and out of the flying vehicle, comprising:

target and guidance processing means on board the vehicle for generating flight control signals;

flight control means on board said vehicle and coupled to said target and guidance processing means and responsive to said flight control signals for guiding said flying vehicle to a target;

reprogramming means, external to said flying vehicle, for providing reprogramming data to said target and guidance processing means prior to launch of said vehicle;

switching means on board said flying vehicle and connected to said target and guidance processing means, to said reprogramming means, and to a first signal path with a portion external to said flying vehicle coupled to the launching apparatus for connecting said target and guidance processing means and said reprogramming means to said first signal path external portion to conduct said reprogramming data to said target and guidance processing means, said external portion of said first signal path being connected to said target and guidance processing means only prior to launch of said vehicle;

a gating means external to said flying vehicle and connected to said first signal path external portion and to a second signal path with a portion external to said flying vehicle coupled to the launching apparatus for gating target and guidance information from said target and guidance processing means on said first signal path in response to a periodic system function signal coupled to said second signal path by said target and guidance processing means, said external portion of said second signal path being coupled to said target and guidance processing means only prior to launch of said vehicle; and a computer means, external to said flying vehicle and connected to said gating means and to said reprogramming means for generating said reprogramming data in response to said target and guidance information;

all communications over the the first and second signal paths external to said vehicle into said vehicle ceasing upon launch of said vehicle.

3. The system of claim 2, wherein said target and guidance information includes a sequence of n words, said gating means including:

a gated counter which counts to n in response to said periodic system function signal and a sequence of data acquisition signals; and a data receiver, connected to said counter, which receives said sequence of n words on said first signal path external portion in response to the counting operation of said counter, said data receiver providing said sequence of data acquisition signals such that one data acquisition signal is provided for each word of said sequence of n words.

4. The system of claim 3, wherein the second signal path is for conducting a periodic targeting signal.

5. The system of claim 4, wherein the periodic targeting signal is included in a utility signal on the second signal path.

6. The system of claim 3, wherein the first signal path is for conducting a gyroscope signal.

7. In a portable missile and launching apparatus, a bi-directional data link, comprising:

a target and guidance processor on board said portable missile;

a first signal path, coupled to said target and guidance processor, with a portion external to said missile and coupled to the launching apparatus for conducting a guidance signal to said target and guidance processor, said external first signal path portion being coupled to said target and guidance processor only prior to launch of said vehicle;

a second signal path, coupled to said target and guidance processor, physically separate from said first signal path, and including a portion external to said portable missile coupled to the launching apparatus, for conducting a periodic signal from said target and guidance processor, said external second signal path portion being coupled to said target and guidance processor only prior to launch of said vehicle;

a reprogrammer external to said portable missile and connected to said first signal path external portion for coupling target and guidance processor programming information to said first signal path external portion in response to a target and guidance processor command from said target and guidance processor on said first signal path external portion;

means in said target guidance processor for coupling processor data to said first signal path in synchronism with said periodic signal;

gated means external to said portable missile, connected to said first signal path external portion and to said second signal path external portion, for receiving said processor data from said first signal path external portion in response to said periodic signal; and an external control computer connected to said reprogrammer and to said gated means for providing said programming information in response to said processor data;

all communications over the first and second signal paths external to said vehicle into said vehicle ceasing upon launch of said vehicle.

8. The bi-directional data link of claim 7, wherein the first signal path is for conducting a gyroscope CAGE function signal.

9. The bi-directional data link of claim 7, wherein the second signal path is for conducting a missile utility signal.

10. The bi-directional data link of claim 9, wherein the missile utility signal includes a periodic targeting acquisition signal.

11. The bi-directional data link of claim 7, wherein the second signal path is for conducting a periodic targeting acquisition signal.

12. The bi-directional data link of claim 7, wherein the means in said target guidance processor includes a multi-state multiplexer having a first state for guidance processor communication and a second state for coupling the processor data to he first signal path.

13. The bi-directional data link of claim 12, wherein the multi-state multiplexer is coupled to the first data path and to the target and guidance processor, further including multiplexer state setting means in the target and guidance processor for switching the state of the target and guidance processor in synchronism with the periodic signal.

14. The bi-directional data link of claim 13, wherein the periodic signal is a periodic targeting acquisition signal.

15. The bi-directional data link of claim 7, wherein the processor data includes a sequence of n words, further including, in the gated means;

a gated counter which counts to n in response to said periodic signal and to a sequence of data acquisition signals; and a data receiver, connected to said gated counter, which receives said sequence of n words on said first signal path in response to the counting operation of said counter, said data receiver providing said sequence of data acquisition signals such that one data acquisition signal is provided for each word of said sequence of n words.

* * * * *